US010156410B1

(12) United States Patent
McKillips et al.

(10) Patent No.: US 10,156,410 B1
(45) Date of Patent: Dec. 18, 2018

(54) TRIGGER MECHANISM FOR A FIREARM

(71) Applicant: WHG Properties, LLC, North Wales, PA (US)

(72) Inventors: Neal McKillips, Drexel Hill, PA (US); William H. Geissele, Lower Gwynedd, PA (US)

(73) Assignee: WHG Properties, LLC, North Wales, PA (US)

( * ) Notice: Subject to any disclaimer, the term of this patent is extended or adjusted under 35 U.S.C. 154(b) by 0 days.

(21) Appl. No.: 15/909,242

(22) Filed: Mar. 1, 2018

(51) Int. Cl.
*F41A 19/10* (2006.01)
*F41A 19/14* (2006.01)
*F41A 19/12* (2006.01)

(52) U.S. Cl.
CPC ..... *F41A 19/10* (2013.01); *F41A 19/12* (2013.01); *F41A 19/14* (2013.01)

(58) Field of Classification Search
CPC ..... F41A 19/14; F41A 19/10; F41A 19/20; F41A 19/16; F41A 19/17; F41A 19/15
USPC ..... 42/69.01–69.03
See application file for complete search history.

(56) References Cited

U.S. PATENT DOCUMENTS 644,402 A 2/1900 Bye
2,406,980 A 9/1946 Young
2,464,427 A 3/1949 Wilson
3,251,268 A 5/1966 Menneking
5,086,579 A 2/1992 Flatley
5,913,261 A 6/1999 Guhring
6,131,324 A * 10/2000 Jewell ..... F41A 19/16 42/69.03
7,600,338 B2 * 10/2009 Geissele ..... F41A 19/10 42/69.03
8,096,079 B2 * 1/2012 Zajk ..... F41A 19/10 49/65
9,046,313 B1 6/2015 Lutton
9,146,066 B1 9/2015 Cason
9,310,150 B1 4/2016 Geissele
9,618,288 B2 4/2017 Wilson
9,638,485 B2 * 5/2017 Geissele ..... F41A 19/10
9,719,744 B2 8/2017 Horch
9,733,034 B1 8/2017 Vianji
9,777,980 B2 10/2017 Heizer
2005/0217652 A1 10/2005 Styles
2006/0101693 A1 * 5/2006 Langlotz ..... F41A 19/16 42/69.01
2009/0183414 A1 * 7/2009 Geissele ..... F41A 19/10 42/69.03
2010/0229843 A1 9/2010 Hu
2011/0079137 A1 4/2011 Audibert
2015/0153126 A1 6/2015 Bender
2015/0338181 A1 11/2015 McAlister
2016/0363401 A1 12/2016 Elftmann
2017/0097204 A1 4/2017 Geissele
(Continued)

*Primary Examiner* — Reginald S Tillman, Jr.
(74) *Attorney, Agent, or Firm* — Fox Rothschild LLP

(57) ABSTRACT

A trigger mechanism for a firearm includes a hammer element pivotable between a ready position and a fired position, and a trigger element pivotable between a first position that retains the hammer element in the ready position, and a second position that releases the hammer element. The hammer element may include a hammer sear having an initial sear surface and a terminal sear surface. The trigger element may include a trigger sear that at least partially engages a portion of the hammer sear when the hammer element is in the ready position.

10 Claims, 8 Drawing Sheets

(56) References Cited

U.S. PATENT DOCUMENTS

| | | | |
|---|---|---|---|
| 2017/0122686 | A1 | 5/2017 | Fellows |
| 2017/0131054 | A1 | 5/2017 | Geissele |

* cited by examiner

TRIGGER MECHANISM FOR A FIREARM

BACKGROUND

Firearms are configured to fire rounds of ammunition. To fire a firearm, the user of the firearm can pull a trigger mechanism, which releases a hammer. The hammer is designed to then strike a firing pin which, in turn, strikes an impact sensitive round of ammunition. Once struck, the round of ammunition expels a bullet from the barrel of the firearm toward a target.

Some shooters (e.g., competitive shooters) prefer a firearm trigger mechanism that requires a low pull back force. This allows for very precise operation of the firearm. However, the lighter the trigger pull, the easier the trigger mechanism is to activate (i.e., pull). Because of this, the risk of an accidental discharge of the firearm is greater. An accidental discharge can occur if the firearm is mishandled or dropped, resulting in a dangerous situation. Therefore, improvements in firearm trigger mechanisms are needed to simulate a sharp, crisp pull for the shooter while maintaining excellent safety features.

SUMMARY

The present disclosure relates generally to a trigger mechanism for a firearm.

In one aspect, the disclosed technology relates to a trigger mechanism for a firearm, including: a hammer element pivotable between a ready position and a fired position, the hammer element comprising a hammer sear; and a trigger element pivotable between a first position configured to retain the hammer element in the ready position, and a second position configured to release the hammer element when the trigger element pivots about a trigger element pin, wherein the trigger element includes a trigger sear that at least partially engages a portion of the hammer sear when the hammer element is in the ready position; and wherein a normal force between the trigger element and the hammer element increases and then decreases when the trigger sear engages the hammer sear. In one embodiment, one of the trigger sear or hammer sear includes an initial sear surface and a terminal sear surface, the initial sear surface having a positive slope and the terminal sear surface having a negative slope. In another embodiment, the initial sear surface is curved. In another embodiment, the terminal sear surface extends from the initial sear surface at a fixed angle. In another embodiment, the length of the initial sear surface is greater than the length of the terminal sear surface. In another embodiment, the hammer element pivots from a pre-cocked position to a cocked position when the trigger sear engages the hammer sear. In another embodiment, kinetic friction between the trigger element and the hammer element decreases when the sear engagement transitions from the initial sear surface to the terminal sear surface. In another embodiment, the trigger mechanism further includes a disconnector pivotable relative to the trigger element and the hammer element. In another embodiment, the trigger mechanism is a single stage trigger. In another embodiment, the trigger mechanism is included in a firearm.

In another aspect, the disclosed technology relates to a firearm including: a trigger mechanism including: a hammer element rotatable about a hammer rotation axis, the hammer element including a hammer sear having an initial sear surface continuous with a terminal sear surface; and a trigger element rotatable independently from the hammer element about a trigger rotation axis, the trigger element including a trigger sear that at least partially engages a portion of the hammer sear when the hammer element is in a ready position; wherein a sear engagement between the trigger element and the hammer element comprises an initial climb followed by a descent with respect to a horizontal axis of the trigger mechanism. In one embodiment, the initial sear surface comprises a positive slope and the terminal sear surface comprises a negative slope. In another embodiment, the initial sear surface is curved. In another embodiment, the terminal sear surface extends from the initial sear surface at a fixed angle. In another embodiment, the hammer element pivots from a pre-cocked position to a cocked position when the trigger sear engages the initial sear surface. In another embodiment, the length of the initial sear surface is greater than the length of the terminal sear surface. In another embodiment, the firearm further includes a safety mechanism configured to disengage and engage the trigger element, the safety mechanism having at least a safe position and a fire position; wherein the safe position is configured to prevent the firearm from firing. In another embodiment, the trigger element is connected to a trigger bow, wherein the trigger element pivots about a trigger element pin when the trigger bow is pulled. In another embodiment, the trigger mechanism further includes a disconnector pivotable relative to the trigger element and the hammer element. In another embodiment, the trigger mechanism is a single stage trigger.

A variety of additional aspects will be set forth in the description that follows. The aspects can relate to individual features and to combinations of features. It is to be understood that both the foregoing general description and the following detailed description are exemplary and explanatory only and are not restrictive of the broad inventive concepts upon which the embodiments disclosed herein are based.

BRIEF DESCRIPTION OF THE DRAWINGS

The following drawings are illustrative of particular embodiments of the present disclosure and therefore do not limit the scope of the present disclosure. The drawings are not to scale and are intended for use in conjunction with the explanations in the following detailed description.

DETAILED DESCRIPTION

Figure 1:
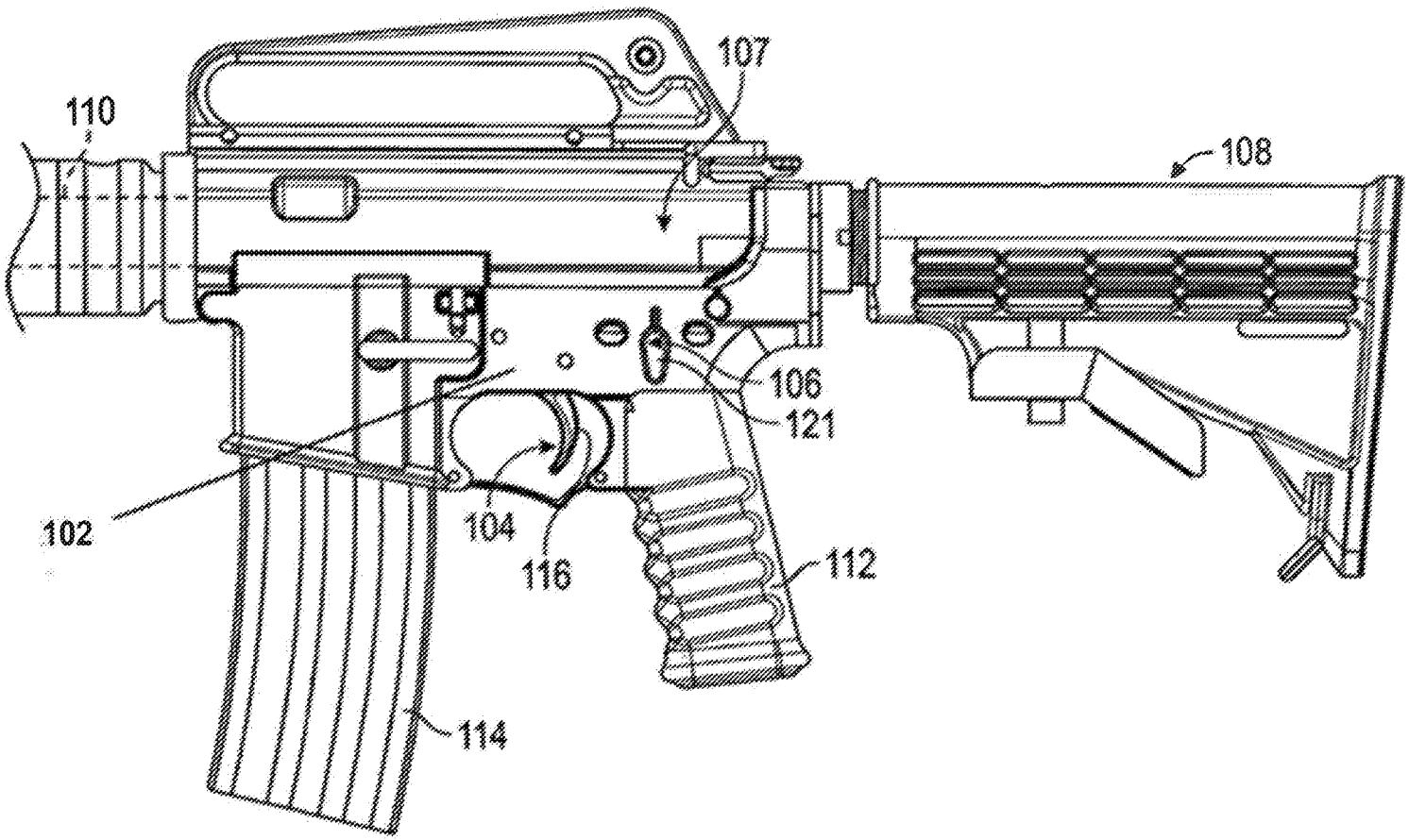
FIG. 1 illustrates a side view of an example firearm.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

FIG. 1 shows an example firearm 100 that includes a receiver body 102. In some embodiments, the receiver body 102 includes a trigger mechanism 104 and a safety mechanism 106. In some embodiments, the firearm 100 may also include at least one of a stock 108, a barrel 110, a grip 112, and a magazine 114.

The firearm 100 is configured to have a plurality of operating modes. The operating modes include at least a safe mode and a fire mode. When the firearm 100 is in the safe mode, the firearm 100 is prevented from discharging a round of ammunition. When the firearm 100 is in the fire mode, the firearm 100 is discharged each time the trigger mechanism 104 is activated (i.e., pulled) without having to manually reload ammunition.

The firearm 100 can be of a variety of types. Examples of a firearm include handguns, rifles, shotguns, carbines, and personal defense weapons. In at least one embodiment, the firearm is a Colt AR-15 rifle or an AR-15 variant.

The receiver body 102 is configured to house a firing mechanism and associated components as found in, for example, assault rifles and their variants. The firing mechanism includes the trigger mechanism 104, which is described and illustrated in more detail with reference to FIGS. 2-6. A bolt assembly (not shown) can also be slidably disposed in the receiver body 102 for axially reciprocating recoil movement therein during a firing cycle sequence of the firearm 100. The bolt assembly is configured to interface with the trigger mechanism 104.

The trigger mechanism 104 includes a trigger bow 116 configured to be pulled by the finger of the shooter (e.g., the index finger) to initiate the firing cycle sequence of the firearm 100. The trigger bow 116 can have a variety of different shapes. For example, the bow can have a generally curved profile. In other examples, the bow can have a generally straight profile.

The trigger mechanism 104 is mounted to the receiver body 102. The trigger mechanism 104 is configured to discharge the firearm 100 when a predetermined amount of force is applied to the trigger bow 116. As described herein, the trigger mechanism 104 can be designed to replace the original equipment manufacturer (OEM) trigger mechanism of the firearm 100 and provide multiple shooting modes, or can be designed as an OEM trigger mechanism. The trigger mechanism 104 is installed in the receiver body 102.

The safety mechanism 106 is configured to facilitate the switching of the firearm 100 between different operating modes. Each operating mode alters the firing operation of the firearm 100. In at least one embodiment, the safety mechanism 106 includes a safety mechanism lever 121 that is switchable between multiple positions, such as a fire mode position and a safe mode position. The safety mechanism 106 is in communication with the trigger mechanism 104. Further, the safety mechanism 106 is disposed in the side of the receiver body 102.

The stock 108 is configured to be positioned at a rearward portion of the firearm 100. The stock 108 provides an additional surface for a shooter to support the firearm 100, typically against the shooter's shoulder. In some embodiments, the stock 108 includes a mount for a sling. In other embodiments, the stock 108 is a telescoping stock. In other embodiments still, the stock 108 is foldable. In some embodiments, the stock 108 is removably mounted to the receiver body 102. In at least one embodiment, the stock 108 is threaded to the receiver body 102. In other embodiments, the stock 108 is secured to the receiver body 102 by a fastener.

The barrel 110 is positioned at a forward end of the firearm 100 and is configured to be installed to the receiver body 102. The barrel 110 provides a path to release an explosion gas and propel a projectile there-through. In some embodiments, the barrel 110 assembly includes a rail system for mounting accessories (e.g., a foregrip, a flashlight, a laser, optic equipment, etc.) thereto. A portion of the barrel 110 is shown in FIG. 1.

The grip 112 provides a point of support for the shooter of the firearm and can be held by the shooter's hand, including when operating the trigger mechanism 104. The grip 112 assists the shooter in stabilizing the firearm 100 during firing and manipulation of the firearm 100. In some embodiments, the grip 112 is mounted to the receiver body 102.

The magazine 114 is an ammunition storage and feeding device within the firearm 100. In at least one embodiment, the magazine 114 is detachably installed on the firearm 100. For example, the magazine 114 may be removably inserted into a magazine well of the receiver body 102 of the firearm 100.

Other embodiments of the firearm 100 may have other configurations than the examples illustrated and described with reference to FIG. 1. For example, some of the components listed above are not included in some alternative embodiments.

Figure 2:
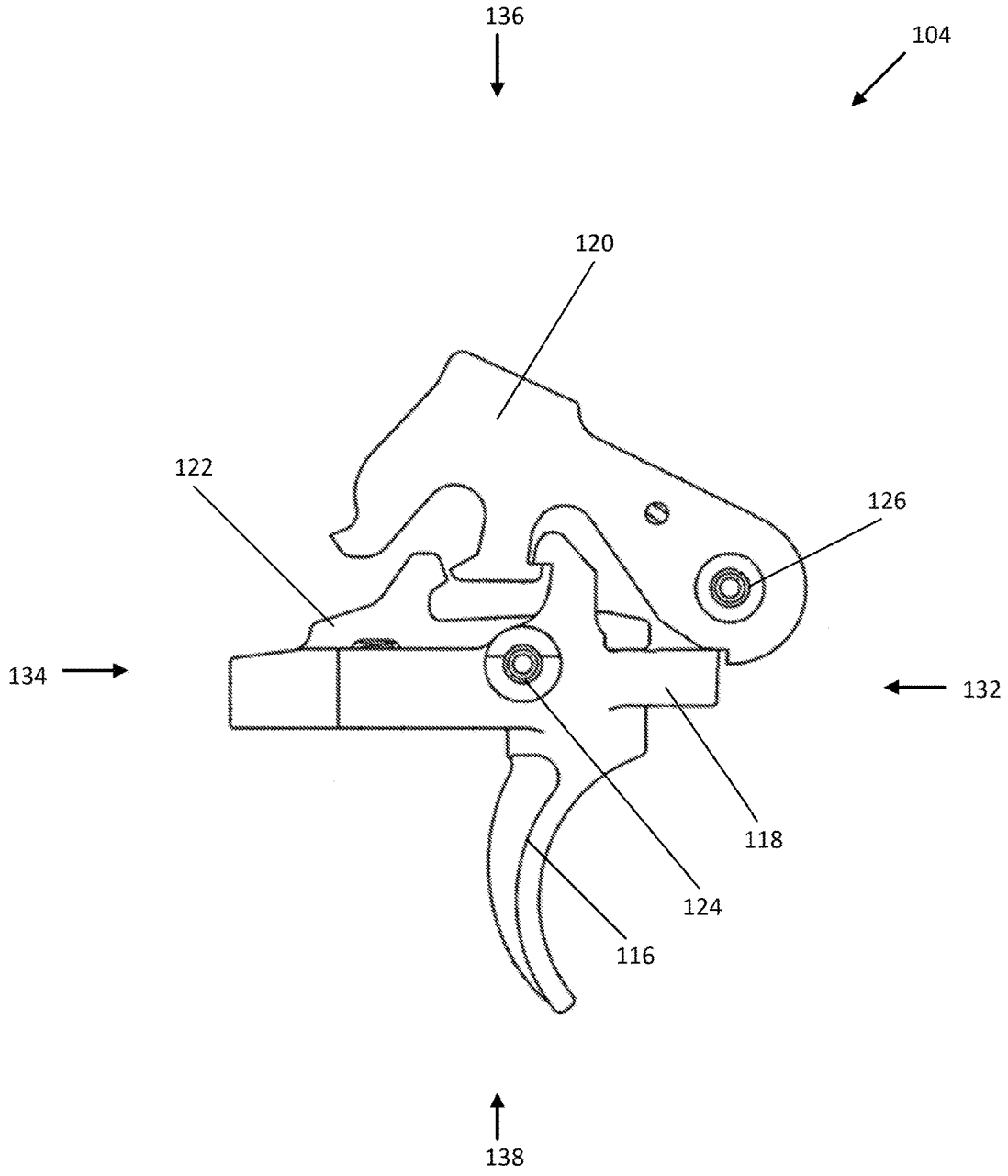
FIG. 2 illustrates a side view of a trigger mechanism suitable for use in the firearm depicted in FIG. 1.

FIG. 2 shows an example trigger mechanism 104 suitable for use in the firearm 100 depicted in FIG. 1. The trigger mechanism 104 includes several pivotable elements such as a trigger element 118, a hammer element 120, and a disconnector 122. The pivotable elements of the trigger mechanism 104 include one or more contact surfaces on which one or more of the other pivotable or movable elements of the trigger mechanism 104 can selectively contact or slide. The trigger mechanism 104 is operated by the interactions between the movable or pivotable elements of the trigger mechanism 104. The interactions can include surface-to-surface contacts between the pivotable elements of the trigger mechanism 104.

In at least one embodiment, the trigger mechanism 104 is configured to provide a single stage trigger mechanism that provides a single stage resistance which causes the firearm 100 to be discharged once the single stage resistance is overcome.

As depicted in FIG. 2, the trigger mechanism 104 is defined by a front 132, a back 134, a top 136, and a bottom 138. Throughout this disclosure, references to orientation (e.g., front(ward), rear(ward), in front, behind, above, below, high, low, back, top, bottom, under, underside, etc.) of structural components shall be defined by that component's positioning in the figures relative to, as applicable, the front 132, the back 134, the top 136, and the bottom 138 of the trigger mechanism 104, regardless of how the trigger mechanism 104, or the attached firearm 100, may be held and regardless of how that component may be situated on its own (i.e., separated from the trigger mechanism 104).

The trigger element 118 is attached to the trigger bow 116, and is configured to pivot when the trigger bow 116 is pulled by a user of the firearm. The trigger element 118 may be connected to a trigger element spring (not shown), which aids in moving the trigger element 118. The trigger element 118 is rotatable about a trigger element pin 124 about a trigger rotation axis. The safety mechanism 106 (depicted in FIG. 1) is configured to disengage and engage the trigger element 118. The safety mechanism 106 has at least a safe position and a fire position. When the safety mechanism 106 is in the safe position, the trigger element 118 is prevented from rotating, which prevents firearm 100 from firing.

The hammer element 120 is rotatable about a hammer element pin 126. The hammer element 120 is connected to a hammer element spring (not shown), which aids in moving the hammer element 120. The hammer element spring engages a hammer element pin sleeve (not shown) so as to allow the hammer element spring to move the hammer element 120. The hammer element pin 126 and the trigger element pin 124 may each be configured to be mounted and secured within the receiver body 102 of the firearm 100.

The disconnector 122 is rotatable about the trigger element pin 124. The disconnector 122 is biased by a disconnector spring (not shown). The disconnector 122 is pivotable relative to the trigger element 118 and the hammer element 120.

The trigger element 118 is pivotable between at least a first position and a second position. When in the first position, a rotation (known as a "trigger pull") of the trigger bow 116 pivots the trigger element 118 about the trigger element pin 124 to the second position, thereby releasing the hammer element 120 and causing discharge of a firearm (e.g., firearm 100 of FIG. 1), to which the trigger mechanism 104 is attached.

The trigger bow 116 is configured to receive a pulling force from the firearm user, usually by way of a finger pull. The rotation of the trigger bow 116 moves the trigger element 118 into the fired position, discharging the firearm. Once in the fired position, a further pull of the trigger bow 116 does not activate the firearm again. Rather, in order for the firearm to discharge again, the trigger bow 116 must be released and the trigger element 118 must be returned from the fired position to the ready position.

Figure 3:
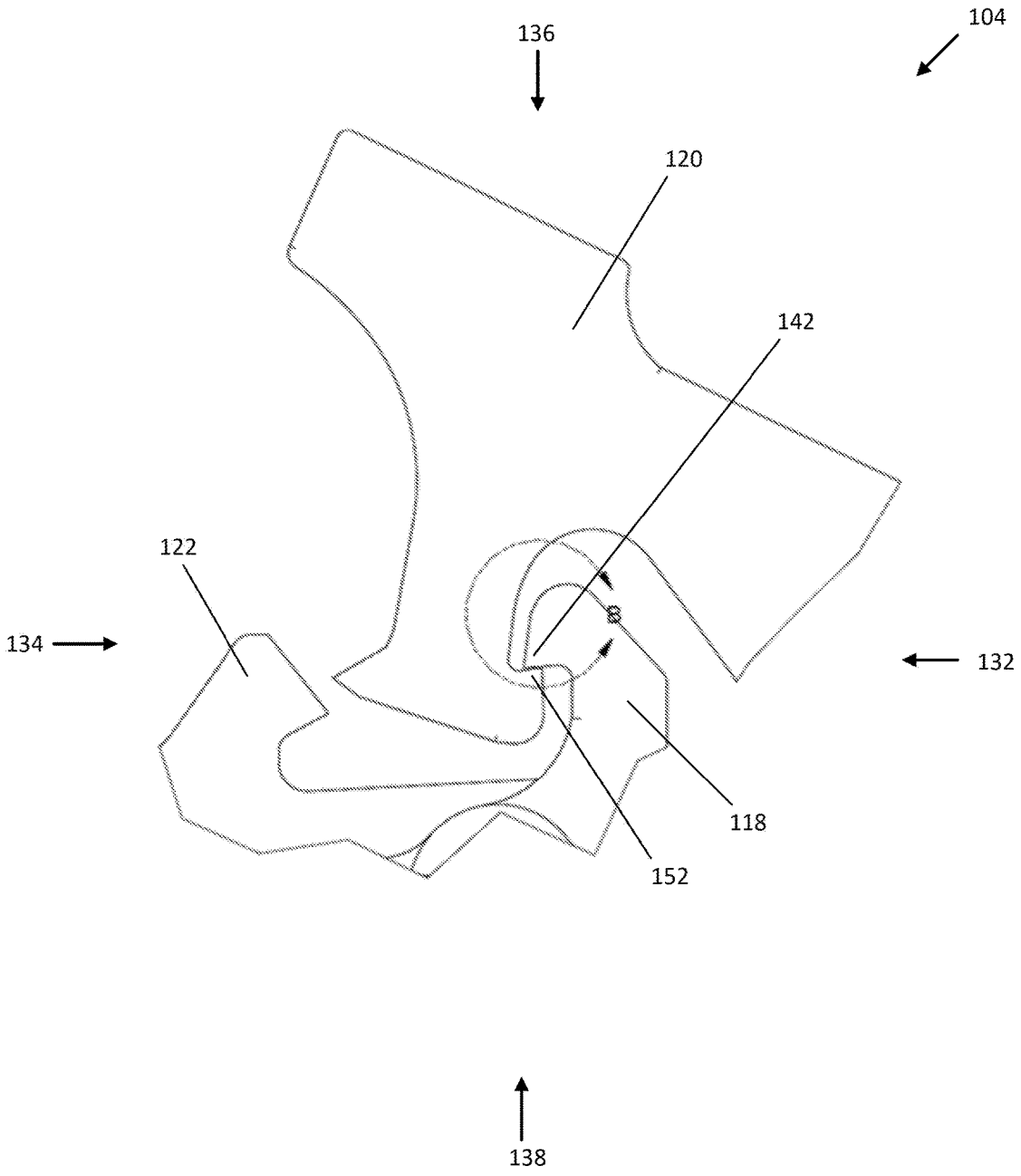
FIG. 3 illustrates a side view of a trigger mechanism in a ready to fire position according to one example of the present disclosure.

FIG. 3 shows an enlarged view of the trigger mechanism 104. The trigger element 118 engages and disengages the hammer element 120. In particular, the trigger element 118 includes a trigger sear 142 that at least partially engages a portion of the hammer element 120.

The hammer element 120 includes a hammer sear 152 that at least partially engages with the trigger sear 142 of the trigger element 118. The hammer element 120 pivots about an axis in both clockwise and counterclockwise directions as depicted in FIG. 3 by rotational movement B. The hammer element 120 pivots between a ready position and a fired position, such that the hammer element 120 strikes a firing pin of a bolt assembly (not shown) of the firearm 100 when it moves from the ready position to the fired position.

Figure 4:
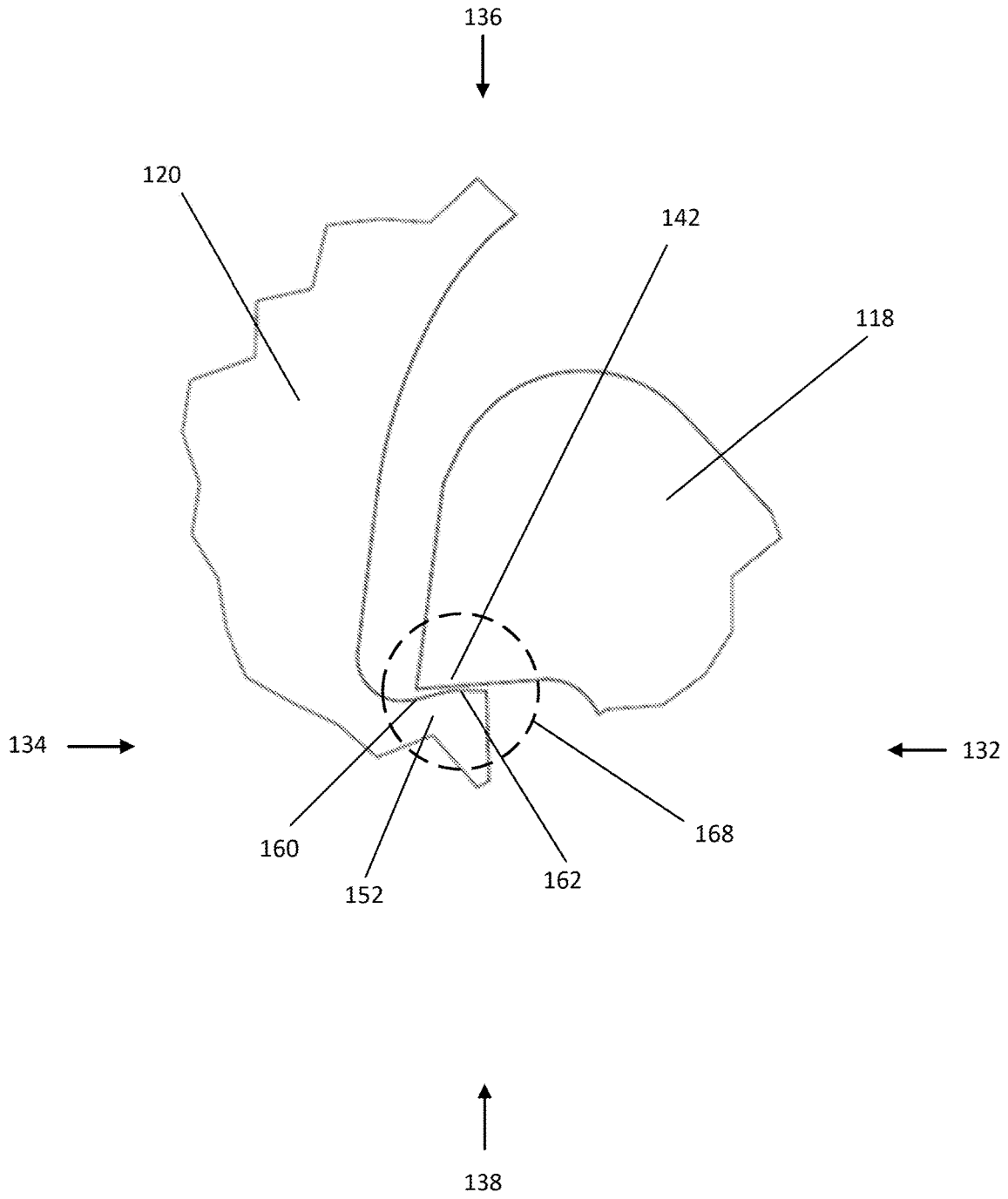
FIG. 4 illustrates an enlarged view of the trigger mechanism of FIG. 3.

FIG. 4 is an enlarged view of the interaction between the trigger element 118 and the hammer element 120. The hammer sear 152 interfaces with a portion of the trigger sear 142 of the trigger element 118. The hammer sear 152 is retained by the trigger sear 142 when the trigger element 118 and the hammer element 120 are in the ready position.

A sear engagement 168 may be defined as the interaction between the trigger sear 142 and the hammer sear 152. In the example arrangement depicted in FIGS. 3-7, the geometry of the hammer sear 152 includes an initial sear surface 160 and a terminal sear surface 162. The initial sear surface 160 is configured to increase the static coefficient of friction between the trigger element 118 and the hammer element 120 by increasing the normal force between the trigger sear 142 and the hammer sear 152. This normal force is increased by the initial sear surface 160 having a positive slope. In some examples, the initial sear surface 160 may have a length of about 0.003 inches to about 0.125 inches, such as about 0.006 inches to about 0.04 inches.

In at least one example, the positive slope of the initial sear surface 160 is curved such that it includes a radius of curvature. The curved shape of the initial sear surface 160 may be defined as a surface that extends at a variable angle with respect to a horizontal axis 170 (shown in FIG. 6) of the trigger mechanism 104. In the examples depicted in FIGS. 3-7, the curved shape of the initial sear surface 160 is convex. The curved shape of the initial sear surface 160 may enhance the feel and longevity of the trigger pull. In some examples, the radius of curvature is 0 inches to about 0.125 inches, such as about 0.018 inches to about 0.09 inches.

Figure 5:
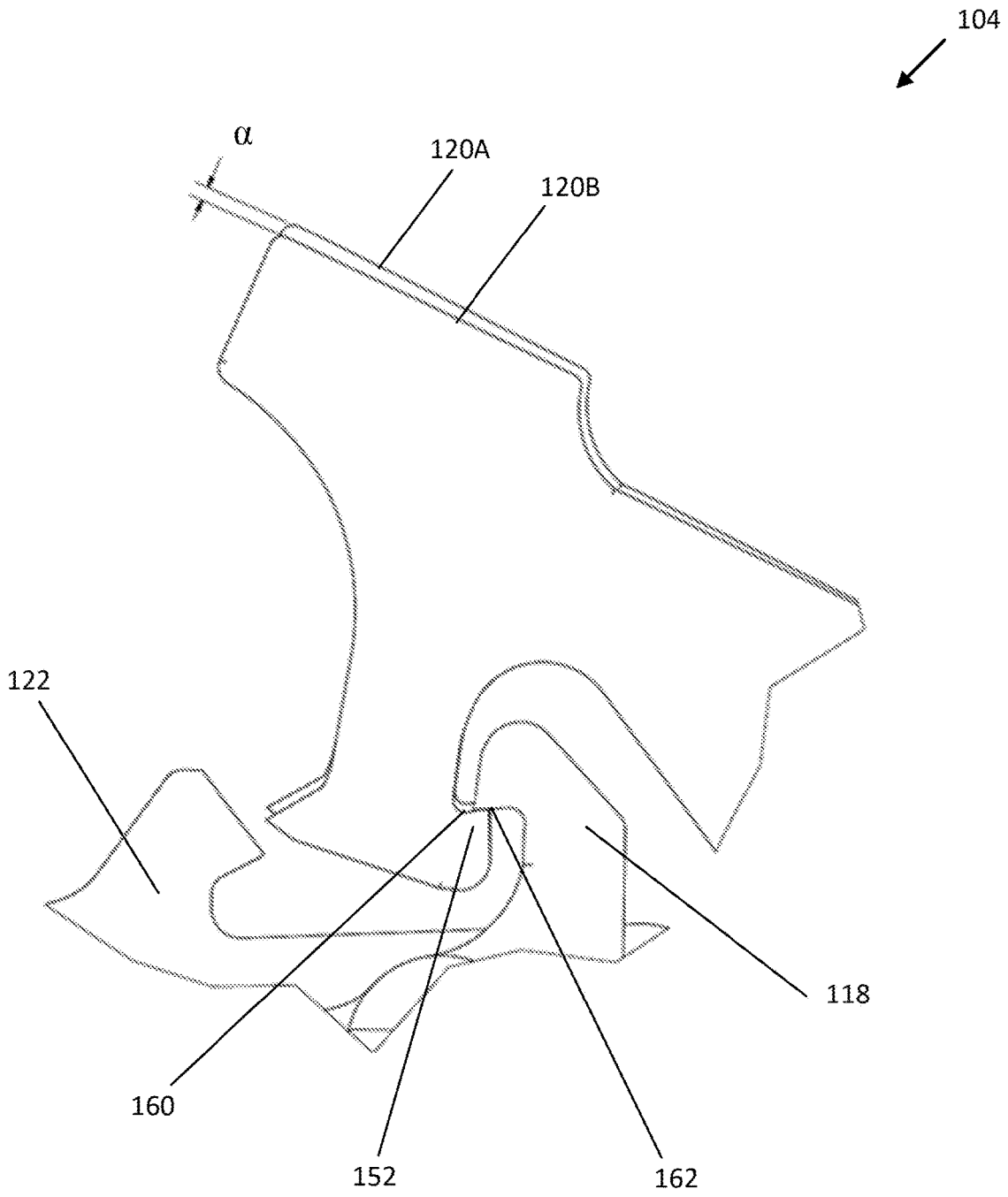
FIG. 5 illustrates a side view of the trigger mechanism showing a cocking movement of a hammer according to one example of the present disclosure.

FIG. 5 depicts a movement of the trigger element 118 relative to the hammer element 120, wherein the positive slope of the initial sear surface 160 causes the hammer element 120 to marginally cock ("pre-cocked position"). FIG. 5 shows the pre-cocked position 120A before the trigger element 118 engages the initial sear surface 160, and a cocked position 120B after the trigger element 118 has engaged the initial sear surface 160. The position of the cocked position 120B with respect to the pre-cocked position 120A is defined by a cocking movement a. In some examples, the cocking movement a is 0 inches to about 0.01 inches.

The cocking of the hammer element 120 by the trigger element 118 translates into an increase in force as detected by the shooter as the shooter pulls the trigger bow. Among the benefits of the cocking movement a is that the trigger element 118 and the hammer element 120 reset themselves to the ready position when the trigger bow is released by the shooter. The ratio of the cocking movement a of the hammer element 120 to the length of the initial sear surface 160 is relatively small such that there is a low initial sear pressure force.

Figure 6:
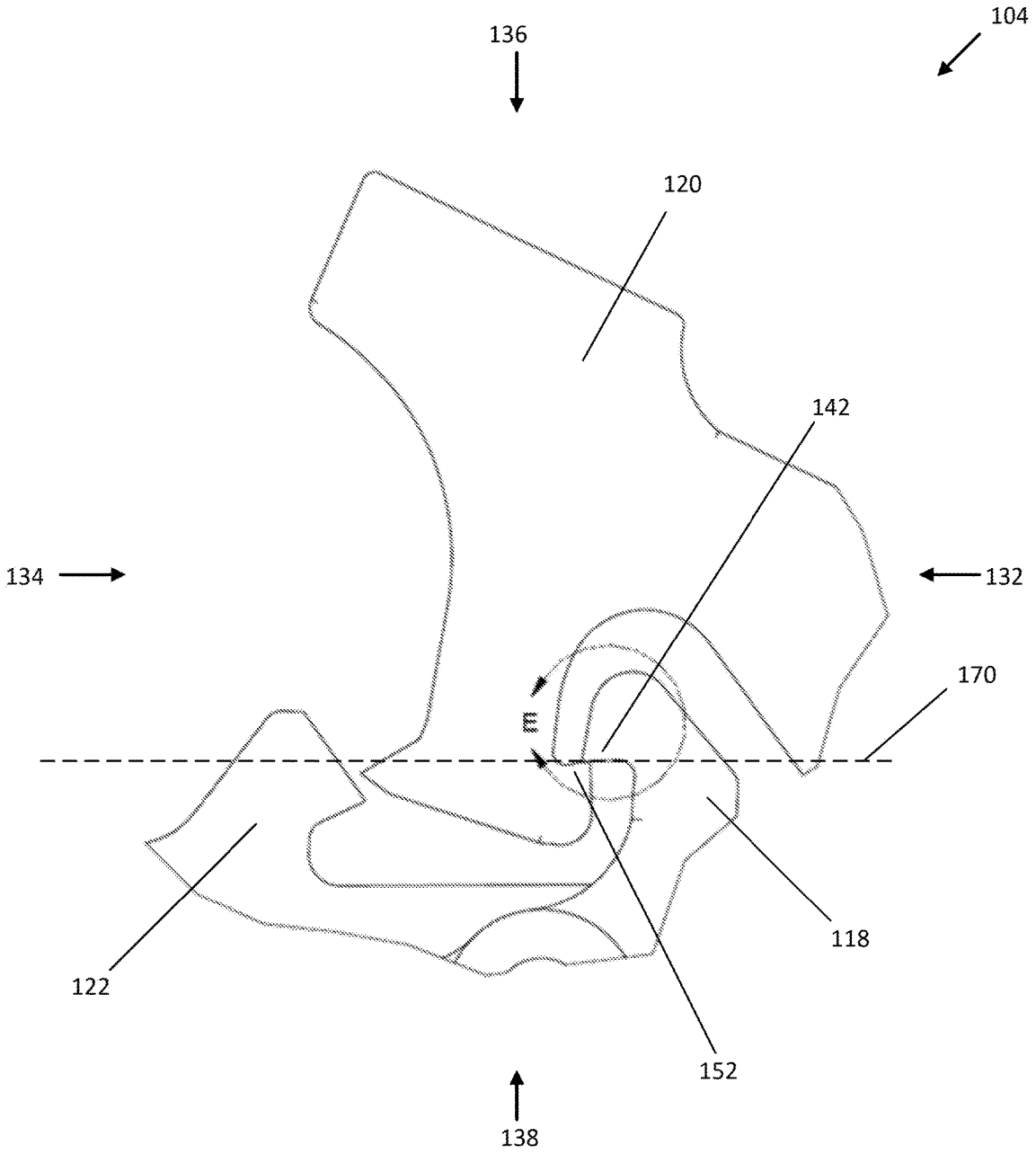
FIG. 6 illustrates a partial disengagement between a trigger element and a hammer element according to one example of the present disclosure.
Figure 7:
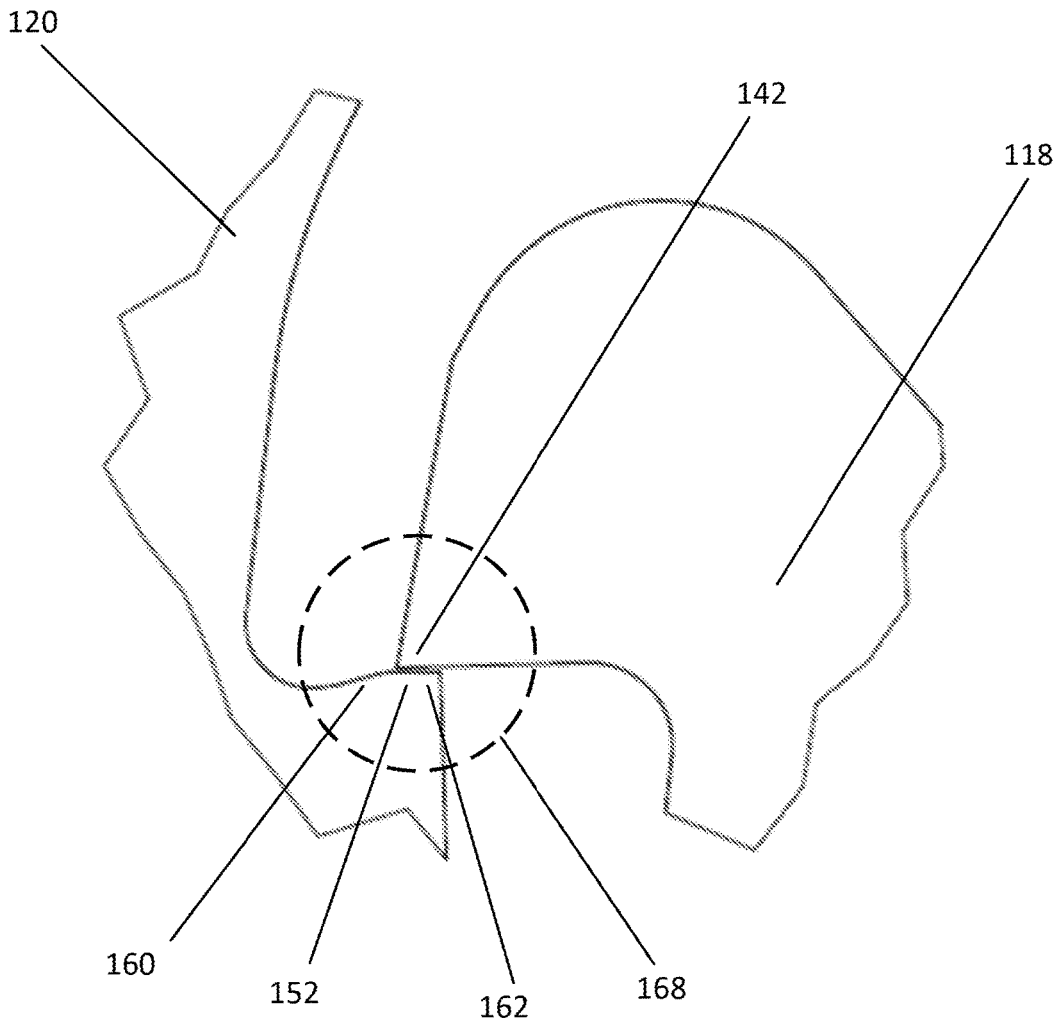
FIG. 7 illustrates an enlarged view of the trigger mechanism of FIG. 6.

FIGS. 6 and 7 show the trigger sear 142 partially disengaged from the hammer sear 152, wherein the terminal sear surface 162 has a negative slope with respect to the positive slope of the initial sear surface 160 along the horizontal axis 170 of the trigger mechanism 104. In some examples, the terminal sear surface 162 may have a length of about 0.003 to about 0.02 inches, such as about 0.004 inches to about 0.006 inches, for providing sufficient sear engagement that enhances the drop safety of a firearm, and further enhances the overall safety of the firearm in case of part failure.

In some examples, the terminal sear surface 162 extends from the initial sear surface 160 at a fixed angle relative to the horizontal axis 170 of the trigger mechanism 104 such that the terminal sear surface 162 is a substantially linear surface. In the trigger mechanism arrangement depicted in FIGS. 3-7, the positive slope of the initial sear surface 160 and the negative slope of the terminal sear surface 162 cause the sear engagement 168 between the trigger element 118 and the hammer element 120 to include an initial climb followed by a descent with respect to the horizontal axis 170 of the trigger mechanism 104. In some examples, the ratio of the length of the initial sear surface 160 to the length of the terminal sear surface 162 is about 2:1 inches to about 1:2 inches, such as about 1.6:1 inches to about 1:1.2 inches.

Figure 8:
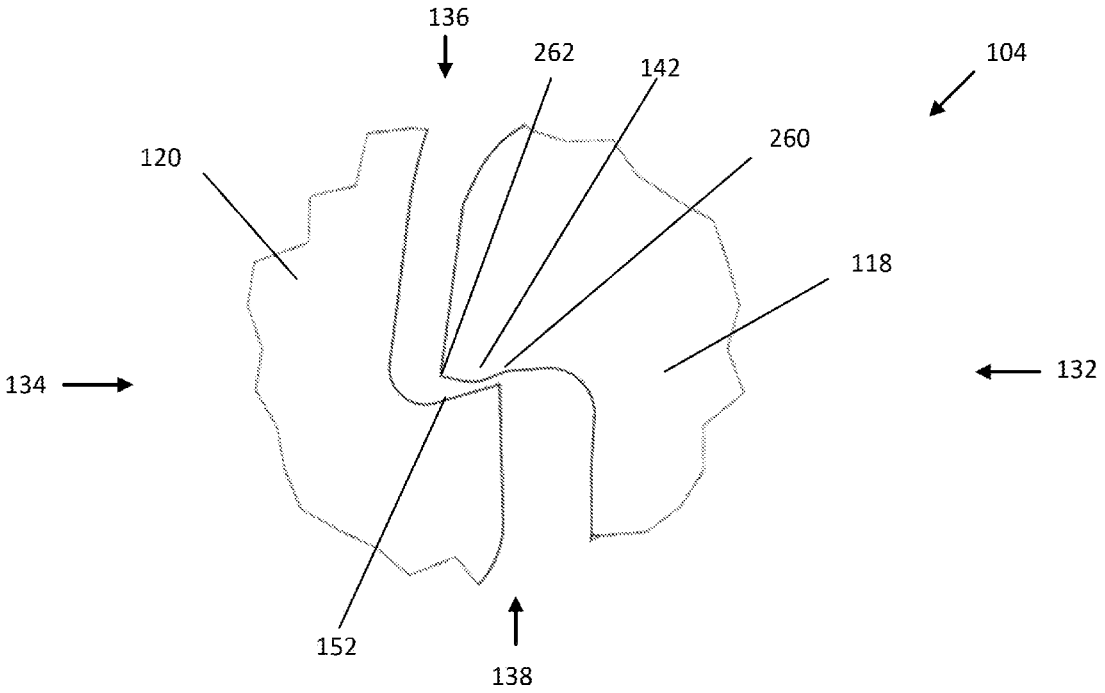
FIG. 8 illustrates an enlarged view of the trigger mechanism according to another example of the present disclosure.

FIG. 8 shows an alternative arrangement of the trigger mechanism 104. In this arrangement, the geometry of the trigger sear 142 includes an initial sear surface 260 and a terminal sear surface 262. The geometry of the hammer sear 152 includes a single surface having a slope that is substantially positive.

In the arrangement depicted in FIG. 8, the initial sear surface 260 is configured to increase the static coefficient of friction between the trigger element 118 and the hammer element 120 by increasing the normal force between the trigger sear 142 and the hammer sear 152. This normal force is increased by the initial sear surface 260 having a positive slope with respect to the horizontal axis 170 of the trigger mechanism 104. In at least one example, the positive slope of the initial sear surface 260 is curved such that it includes a radius of curvature. In the examples depicted in FIGS. 8 and 9, the curved shape of the initial sear surface 260 is concave. The positive slope of the initial sear surface 260 causes the hammer element 120 to marginally cock when the trigger sear 142 engages the hammer sear 152.

Figure 9:
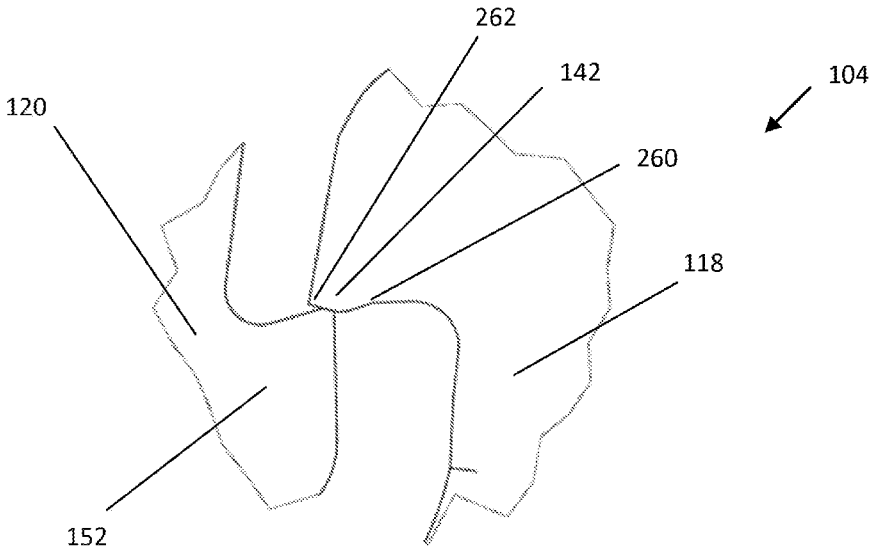
FIG. 9 illustrates a partial disengagement between a trigger element and a hammer according to the example depicted in FIG. 8.

FIG. 9 shows the trigger sear 142 of the arrangement of FIG. 8 partially disengaged from the hammer sear 152, wherein the terminal sear surface 262 has a negative slope with respect to the positive slope of the initial sear surface 260 along the horizontal axis of the trigger mechanism 104. In at least one example, the terminal sear surface 262 extends from the initial sear surface 260 at a fixed angle relative to the horizontal axis of the trigger mechanism 104 such that the terminal sear surface 262 is a substantially linear surface.

In the arrangement depicted in FIGS. 8 and 9, the positive slope of the initial sear surface 260 and the negative slope of the terminal sear surface 262 cause the sear engagement 168 between the trigger element 118 and the hammer element 120 to have an initial descent followed by a climb with respect to the horizontal axis of the trigger mechanism 104.

In examples of the sear mechanism, the sear engagement 168 provides a normal force between the trigger element 118 and the hammer element 120 that increases and then gradually decreases as the trigger sear 142 engages the hammer sear 152. Thus, the kinetic friction between the trigger element 118 and the hammer element 120 decreases as the sear engagement 168 between the trigger element 118 and the hammer element 120 transitions from the initial sear surface 160 or 260 to the terminal sear surface 162 or 262.

The difference in kinetic friction between the initial sear surface 160 or 260 and the terminal sear surface 162 or 262 provides the shooter with the feeling of a sharp pull with little take-up. This may occur because as the shooter pulls the trigger bow to discharge the firearm, the shooter will detect an initial pull weight followed by a sharp decrease in pull weight. This is particularly advantageous for shooters who prefer trigger mechanisms with a low pull back force.

In addition to providing a sharp trigger pull, the sear engagement 168 allows the trigger element 118 to engage the hammer element 120 at the terminal sear surface 162 or 262 which further enhances the safety of the trigger mechanism 104. The trigger sear 142 sits on the terminal sear surface 162 or 262 due to a force from the trigger element spring which also forces the trigger element 118 to reset into the first position such that it does not slide off the terminal sear surface 162 or 262 unless a trigger pull is completed. This can prevent an unintentional discharge of the firearm by enhancing the drop safety of the firearm and further enhancing overall firearm safety in case of part failure. Accordingly, the sear engagement 168 enhances the safety of the trigger mechanism 104 while also providing the feel of a sharp, crisp pull to the shooter.

As used herein, the term "about" in reference to a numerical value means plus or minus 15% of the numerical value of the number with which it is being used.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

We claim:

1. A trigger mechanism for a firearm, comprising:

a hammer element pivotable between a ready position and a fired position, the hammer element comprising a hammer sear; and a trigger element pivotable between a first position configured to retain the hammer element in the ready position, and a second position configured to release the hammer element when the trigger element pivots about a trigger element pin, wherein the trigger element comprises a trigger sear that at least partially engages a portion of the hammer sear when the hammer element is in the ready position; and wherein a normal force between the trigger element and the hammer element increases and then decreases when the trigger sear engages the hammer sear.

2. The trigger mechanism of claim 1, wherein one of the trigger sear or hammer sear comprises an initial sear surface and a terminal sear surface, the initial sear surface having a positive slope and the terminal sear surface having a negative slope.

3. The trigger mechanism of claim 2, wherein the initial sear surface is curved.

4. The trigger mechanism of claim 3, wherein the terminal sear surface extends from the initial sear surface at a fixed angle.

5. The trigger mechanism of claim 2, wherein the length of the initial sear surface is greater than the length of the terminal sear surface.

6. The trigger mechanism of claim 1, wherein the hammer element pivots from a pre-cocked position to a cocked position when the trigger sear engages the hammer sear.

7. The trigger mechanism of claim 2, wherein kinetic friction between the trigger element and the hammer element decreases when the sear engagement transitions from the initial sear surface to the terminal sear surface.

8. The trigger mechanism of claim 1, further comprising a disconnector pivotable relative to the trigger element and the hammer element.

9. The trigger mechanism of claim 1, wherein the trigger mechanism is a single stage trigger.

10. A firearm comprising the trigger mechanism of claim 1.

* * * * *